US007832623B1

(12) United States Patent
Capogrosso

(10) Patent No.: US 7,832,623 B1
(45) Date of Patent: Nov. 16, 2010

(54) CARTON WITH ARCUATE BOTTOM SCORE AND SCORED SIDE WALL AND FLAP

(75) Inventor: Andrew M. Capogrosso, Fremont, OH (US)

(73) Assignee: Green Bay Packaging, Inc, Green Bay, WI (US)

( * ) Notice: Subject to any disclaimer, the term of this patent is extended or adjusted under 35 U.S.C. 154(b) by 163 days.

(21) Appl. No.: 12/194,954

(22) Filed: Aug. 20, 2008

Related U.S. Application Data

(60) Provisional application No. 60/970,014, filed on Sep. 5, 2007.

(51) Int. Cl.
*B65D 5/10* (2006.01)
*B65D 5/42* (2006.01)

(52) U.S. Cl. ..... 229/125; 229/157

(58) Field of Classification Search ..... 229/125, 229/157, 132, 136
See application file for complete search history.

(56) References Cited

U.S. PATENT DOCUMENTS 2,415,869 A * 2/1947 Coleman ..... 229/135
2,961,140 A * 11/1960 Holmes ..... 229/117.33
3,078,989 A * 2/1963 Curran et al. ..... 206/440
3,166,235 A * 1/1965 Schroeder ..... 229/120
4,279,379 A * 7/1981 Lohrbach et al. ..... 229/185
4,437,570 A * 3/1984 Sorenson ..... 229/204
5,318,220 A * 6/1994 Gagliardo ..... 229/157
5,738,272 A * 4/1998 Anchor et al. ..... 229/109
6,119,928 A * 9/2000 Lasson et al. ..... 229/5.82

* cited by examiner

*Primary Examiner*—Gary E Elkins
(74) *Attorney, Agent, or Firm*—Boyle Fredrickson S.C.

(57) ABSTRACT

A carton particularly well suited for storing packaged dry goods is designed such that the closure flaps that close a top opening of the carton do not obstruct the loading of goods into the carton through the top opening when the carton is placed on its side. The carton includes a front and rear panel that bow slightly outwardly so as to apply tension to the closure flaps connected to the front and rear panel. This tension prevents the flaps from falling into the opening during loading of the carton. This tension is created by vertical score lines in the front and rear panels as well as their associated closure flaps. In this regard, the mechanism to hold the closure flaps open is integrally formed with the carton.

11 Claims, 4 Drawing Sheets

CARTON WITH ARCUATE BOTTOM SCORE AND SCORED SIDE WALL AND FLAP

CROSS-REFERENCE TO RELATED APPLICATION

This application claims the benefit of U.S. Ser. No. 60/970,014, filed Sep. 5, 2007, the disclosure of which is incorporate herein by reference.

FIELD OF THE INVENTION

The present invention relates generally to reusable storage containers and, more particularly, to a reusable corrugated or cardboard carton formed from a blank scored to have a series of folding lines along which the blank may be folded to erect the carton, and well-suited for storing dry goods such as packaged foodstuffs.

BACKGROUND OF THE INVENTION

Corrugated or cardboard cartons are commonly used for storing and transporting dry goods such as packaged foodstuffs. A typical carton has a set of top panels, a set of bottom panels, and a set of wall panels extending between the top panels and the bottom panels. When erecting the carton, the blank is folded along the score lines between the wall panels thereby resulting in an open-ended, generally rectangular container. The bottom panels are then folded inwardly, and in some cases frictionally held together, to close the bottom end of the container. In one representative type of packaging process, such a partially erected carton is laid on its side on a conveyor belt or track and then loaded from the side with packaged foodstuffs, such as snack chips, or other goods. Once loaded, the carton is rotated upright and the top panels are folded inwardly to close the top opening of the carton.

For an initial loading with such a packaging process, the top panels are not folded at their score lines until after the carton is loaded. Because of the rigidity of the blank, the top panels are generally in-line with the wall panels and thus do not block the top opening of the carton. However, after the top panels are folded after the initial loading, the aforementioned rigidity is lost and the top panels tend to sag into the interior of the carton. As a result, when the cardboard carton is reused, the top panels may block the opening into the carton and ultimately be pushed inwardly into carton as the carton is loaded. Since the carton is designed to be reused numerous times, the top panels become weakened with each use and therefore sag further with each use. One known solution is to use tape to maintain the top panels in an open position by temporarily adhering the top panel to the side panels. While effective in keeping the opening into the carton cleared, the use of tape or other mechanical means requires additional labor, cost and may even cause damage to and hasten the end of the life cycle of the carton.

SUMMARY OF THE INVENTION

The present invention is directed to a carton having a generally rectangular footprint that is defined in part by a pair of arcuate wall panels adjacent a pair of closure flaps. The wall panels are segmented from the closure flaps by horizontal score lines that also define the folding axes for the closure flaps. In addition to the horizontal score lines, a pair of vertical score lines extend from a base of the wall panels to a top edge of the closure flaps. The vertical score lines define flex points for the wall panels and the closure flaps to bow slightly outward and impart tension on the wall panels and the closure flaps. This tension effectively counters the fatigue of the closure flaps typically associated with repeated use of the carton, thereby allowing the carton to be repeatedly used with less risk of the closure flaps blocking the opening into the carton or being pushed inwardly into the carton as the carton is loaded.

Therefore, it is an object of the present invention to provide a carton having a usable life exceeding that of conventional cartons.

It is another object of the invention to provide a reusable carton that presents an opening for subsequent loading that is generally equal to the opening that was presented for loading when the carton was initially loaded.

In it another object of the invention to provide a paper-based carton formed from a blank and constructed to counter the effects of fatigued closure flaps so that there is less likelihood that the closure flaps will obstruct the opening to the carton during loading of the carton.

Various other features and advantages of the present invention will be made apparent from the following detailed description and the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
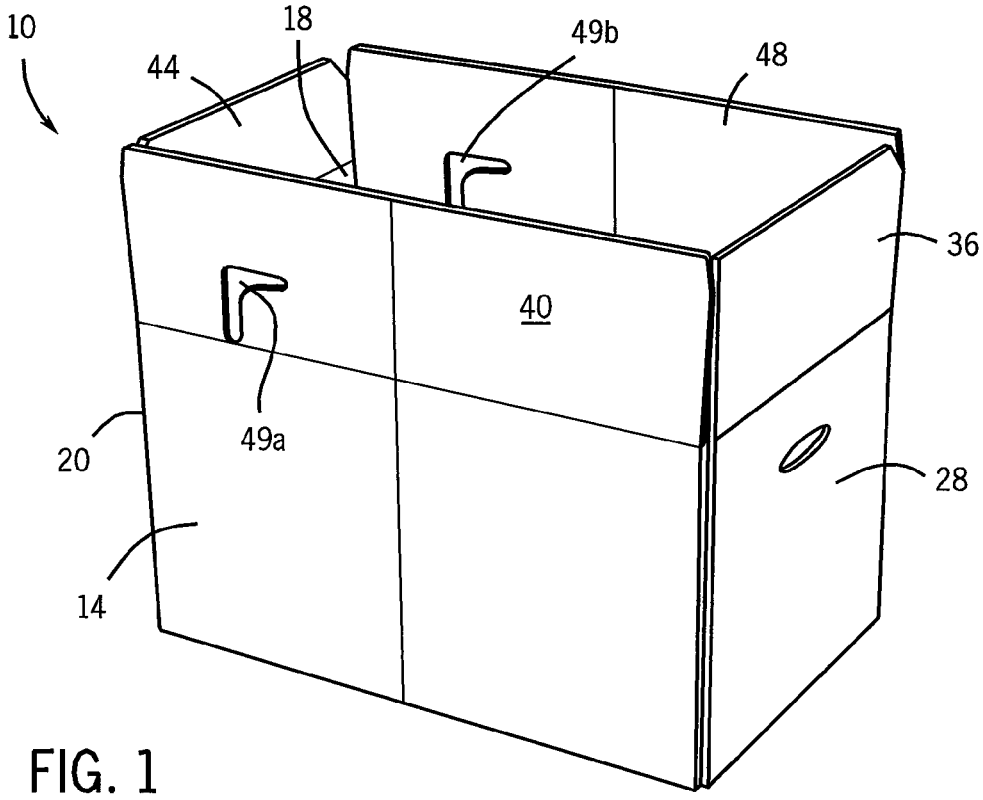
FIG. 1 is an isometric of an opened carton according to an embodiment of the present invention.
Figure 2:
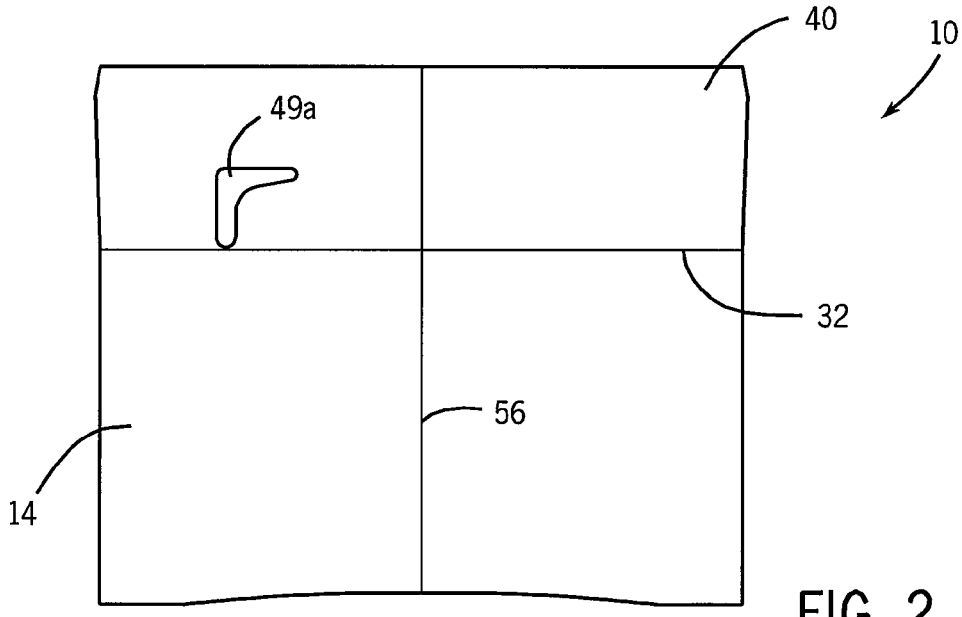
FIG. 2 is a side elevation view of the carton shown in FIG. 1.
Figure 3:
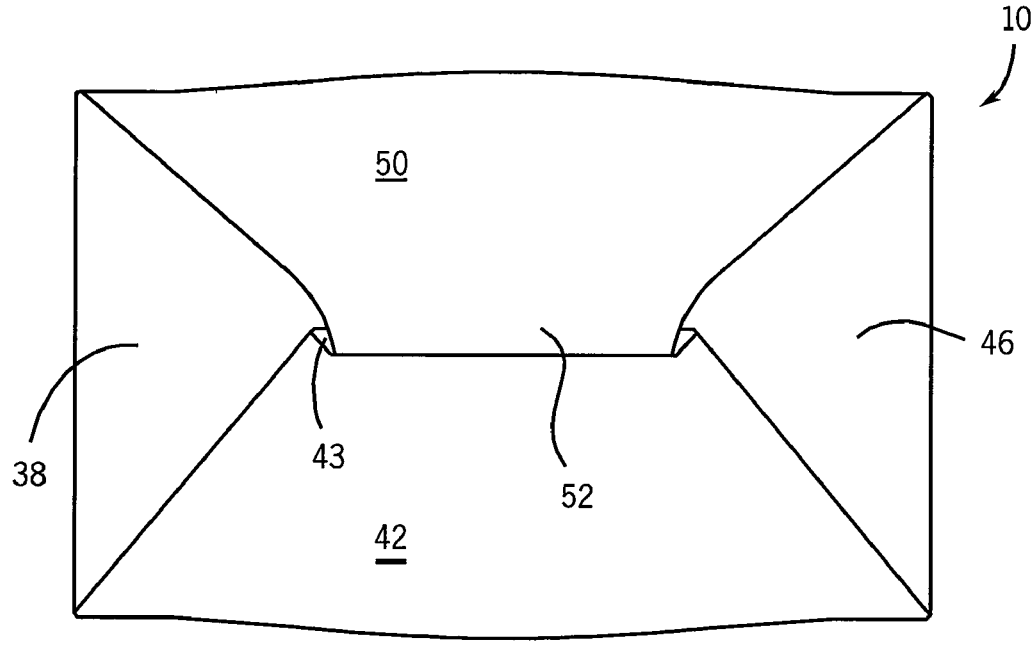
FIG. 3 is a bottom plan view of the carton shown in FIG. 1.
Figure 4:
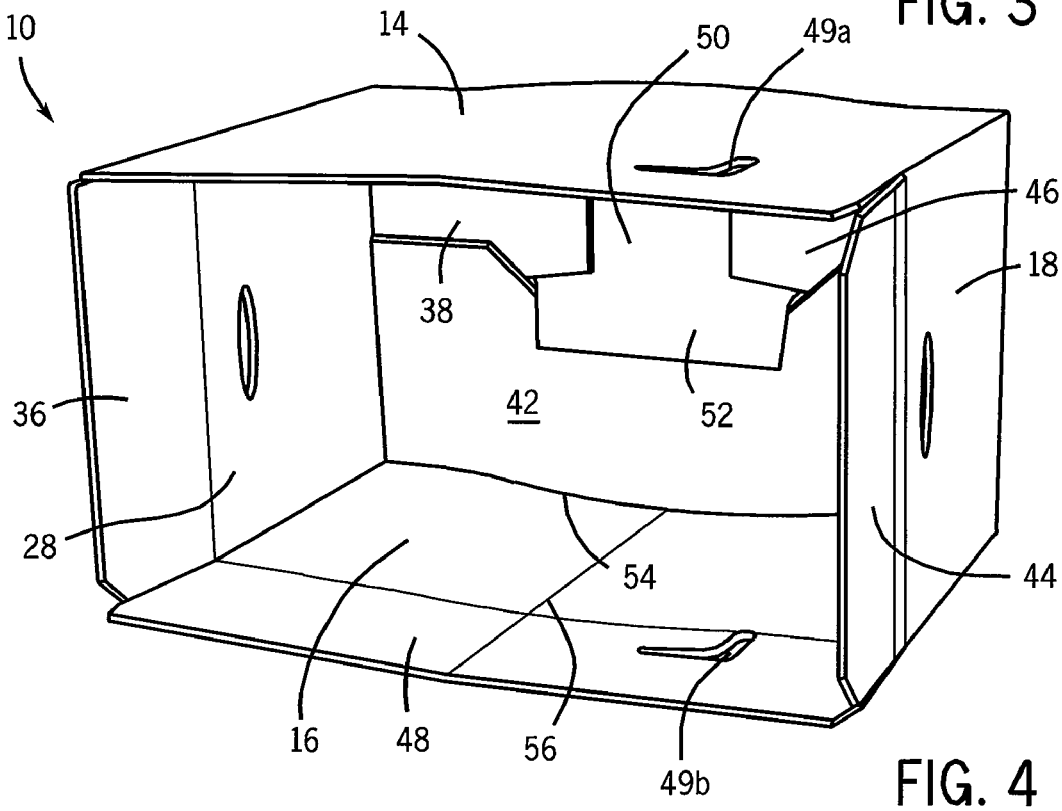
FIG. 4 is an isometric view of the carton shown in FIG. 1 with the cardboard carton lying on its side.

A container or carton 10 constructed in accordance with the present invention is shown in FIGS. 1-4. FIG. 1 shows the carton 10 partially assembled such that a top opening through which goods, such as packaged foodstuffs, may be loaded. FIG. 2 is a side elevation view of the carton 10 and FIG. 3 is a bottom view of the carton 10. As will be described in greater detail below, when used with one type of packaging process, the carton is laid on its side for loading thereof, such as illustrated in FIG. 4.

Figure 6:
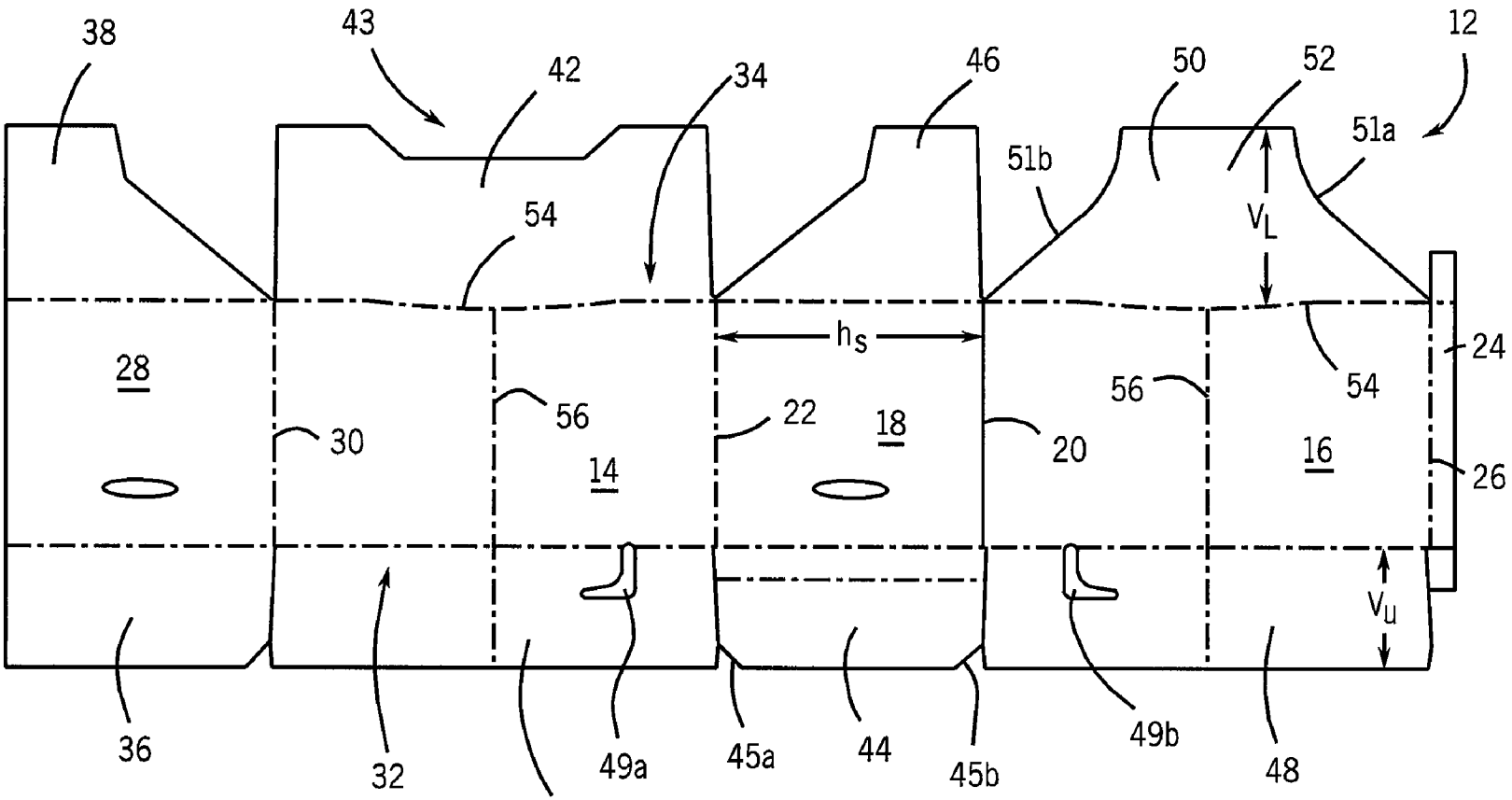
FIG. 6 is a top plan view of a blank from which the carton of FIG. 1 can be made according to one embodiment of the present invention.

The carton may be made from a one piece blank 12, shown in FIG. 6, of corrugated board, cardboard, paperboard, or other suitable, foldable sheet material. The carton 10 has a front panel 14, a back panel 16, and a first side panel 18 located between front and back panels 14 and 16, and defined by vertical fold lines 20 and 22. An inner side tab 24 extends from the back panel 16 at a vertical fold line 26, and a second side panel 28 extends from front panel 14 at a vertical fold line 30. The upper and lower edges of the panels 14, 16, 18, 28 are defined by a continuous upper horizontal fold line 32 and a lower, substantially horizontal, fold line 34. "Upper" and "lower" define the position of the fold lines when the carton is erected rather than when in the position shown in FIG. 6.

Second side panel 28, front panel 14, first side panel 18, and back panel 16 each have upper and lower closure flaps extending from the upper 32 and lower 34 horizontal fold lines, respectively. Specifically, second side panel 28 includes a rectangular upper closure flap 36 and an irregular lower closure flap 38. Front panel 14 includes rectangular upper and lower closure flaps 40, 42, respectively. Lower closure flap 42 includes a cut-out tab-receiving portion 43. First side panel 18 includes an upper closure flap 44 having beveled corners 45*a*, 45*b* and an irregular lower closure flap 46. Back panel 16 includes a rectangular upper closure flap 48 and a lower closure flap 50 having angled edges 51*a*, 51*b* ending at a bottom closure tab 52. Upper closure flaps 40, 48 also include first and second cut-out receiving portions, or slots, 49*a*, 49*b* configured to receive the beveled corners 45*a*, 45*b* of closure flap 44.

The vertical dimension $v_U$ of the upper rectangular closure flaps 36, 40, 44, 48 is approximately half of the horizontal dimension $h_S$ of the side panels 18, 28 while the vertical dimension $v_L$ of the lower closure flaps 38, 42, 46, 50 is approximately two thirds the horizontal dimension $h_S$. As shown in FIG. 4, when erected into a carton 10, lower closure flaps 38, 46 are folded over and overlapped by lower closure flaps 42, 50. The bottom closure tab 52 is inserted into the tab-receiving portion 43 to securely close the bottom of the carton 10. To close the top of the carton 10, upper closure flap 36 is folded over and overlapped by upper closure flaps 40, 48. Flap 44 is then folded over flaps 40, 48 with corners 45*a*, 45*b* inserted into cut-outs 49*a*, 49*b* to securely close the upper flaps.

The upper and lower fold lines 32, 34 are formed by creating a score in the blank 12 as is known in the art. The upper fold line 32 is a straight line extending throughout the length of the blank 12. As shown in FIG. 1, the lower fold line 34 has two distinct arcuate, or curved, score sections 54 located between the front and back panels 14, 16 and their respective lower closure flaps 42, 50. The front and back panels 14, 16 further contain vertical scores 56 extending through their respective upper closure flaps 40, 48.

In erecting the carton 10 from the blank 12 as described, panels 14, 16, 18, 28 are folded about fold lines 20, 22, 26, 30 to form a rectangular tube in which second side panel 28 overlaps inner side tab 24. Glue or another suitable adhering means, is applied to the overlap so as to fixedly secure the facing surfaces of inner side tab 24 and side panel 28 together. In order to close the bottom of the carton, lower panel closure flaps 38, 46 are first bent inwardly as described above. Lower flap 42 and tapered flap 50 are then bent inwardly such that retaining tab 50 is engaged within the tab-receiving portion 43 of lower closure flap 42 and held via a friction fit, as shown in FIG. 3. After the carton 10 has been loaded, upper closure flap 44 is bent inwardly over upper closure flaps 40, 48 which are folded over closure flap 36 as described above. The beveled corners 45*a*, 45*b* of upper closure panel 44 are inserted into slots 49*a*, 49*b* and held via a friction fit to securely hold the upper closures flaps 36, 40, 44, and 48 closed.

Figure 5:
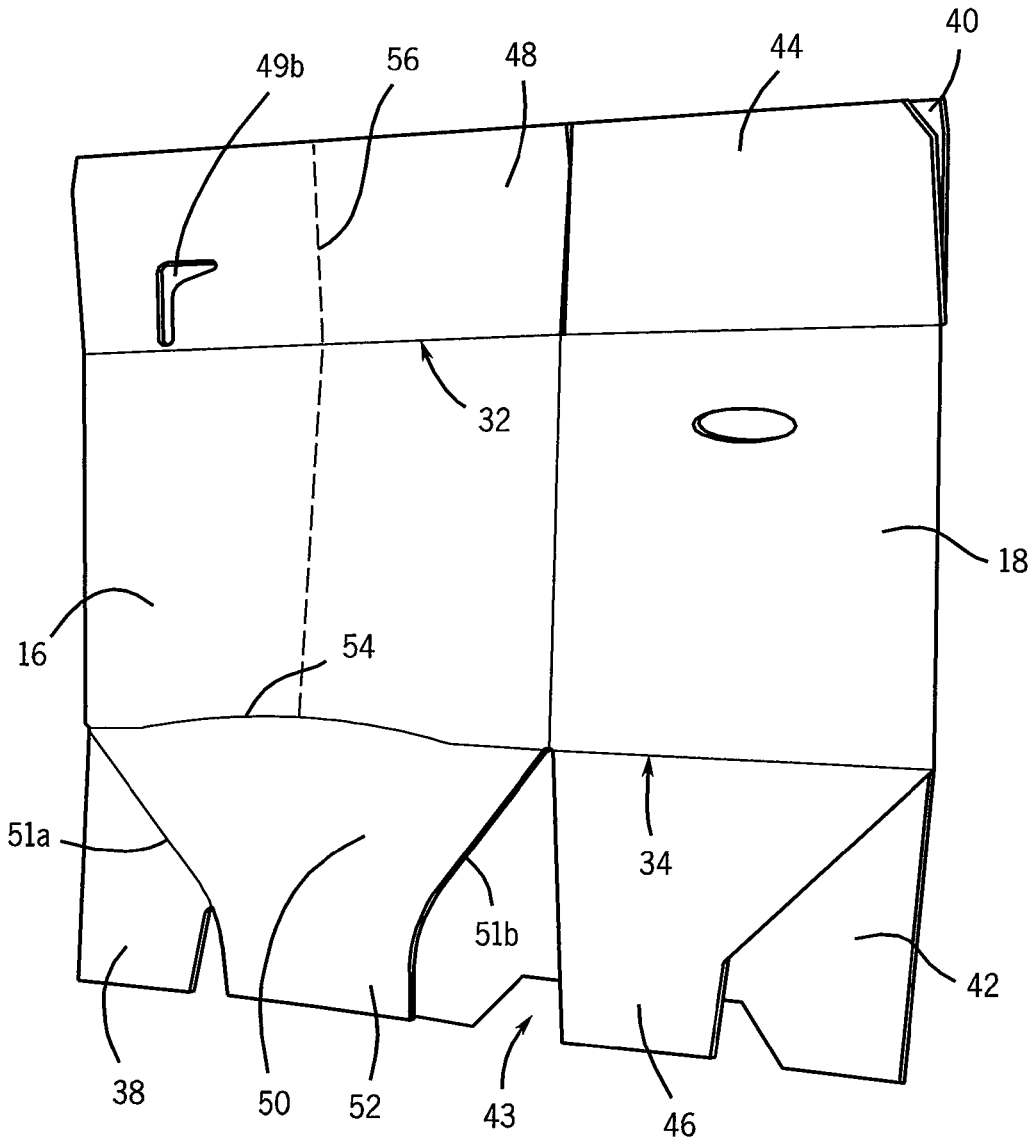
FIG. 5 is an isometric view of the carton of FIG. 1 after being broken down to lie flat.

Before the carton 10 is used for the first time, a user initially erects the carton 10 as described above, except for the top closure flaps 36, 40, 44, 48. When lower closure panels 38, 42, 46 and 52 are folded, the two curved sections 54 in the bottom fold line 34 create tension that is transmitted to the front and back panels 14, 16 and respective upper closure flaps 40, 48. The tension in the panels 14, 16 is experienced by the vertical scores 56, which causes the front and back panels 14, 16 and upper closure flaps 40, 48 of the carton 10 to bow slightly outward, creating a shallow V-shaped configuration of the front and back panels 14, 16 and respective upper closure flaps 40, 48. This bowing action causes the upper flaps 40, 48 to stiffen and remain erect when the carton 10 is placed on its side, as illustrated in FIG. 4, in a position in which either the front or back panel 14, 16 faces downwardly. The bottom curved score sections 54 are shaped in a generally arcuate manner such that sufficient tension is provided to keep the upper closure flaps 40, 48 erect while still maintaining an essentially rectangular footprint for the assembled carton 10. A user may, either manually or via automated machinery, fill the partially assembled carton 10 with items without interference from the upper flaps 40, 48 and without the need for tape or any other mechanical means. The carton 10 may be repeatedly erected, filled, shipped, and unloaded, and then broken down, as shown in FIG. 5, to a flat configuration and returned for subsequent erection and filling, while still providing the ability to maintain the upper flaps 40, 48 in a self-supporting open condition during the filling operation.

While the invention has been shown and described with respect to a specific embodiment, it is contemplated that certain details may vary from the specific construction as disclosed, while still falling within the scope of the present invention. For example, the lower fold line 34 may have only one curved score section 54, e.g., between front panel 14 and flap 42 and one vertical score 56 extending from the curved score 54 across the front panel 14 and upper closure panel 40, while remaining within the scope of the present invention.

In addition, while the score sections 52 are illustrated as being arcuate, it is also understood that the score sections 52 may have a shallow V-type configuration formed by a pair of linear scores, or may have any other non-linear configuration.

The present invention has been described in terms of the preferred embodiment, and it is recognized that equivalents, alternatives, and modifications, aside from those expressly stated, are possible and within the scope of the appending claims.

I claim:

1. A carton comprising:

a front panel, a back panel, a first side panel, and a second side panel, all of the panels each having a top edge, a bottom edge, and first and second side edges;

a front upper flap and a back upper flap, each having a top edge, a bottom edge, and two opposing unconnected side edges, the bottom edge of the front upper flap and the top edge of the front panel being connected about a first fold line, the bottom edge of the back upper flap and the top edge of the back panel being connected about a second fold line; and a front lower flap and a back lower flap, each having a top edge, a bottom edge, and two opposing side edges, the top edge of the front lower flap and the bottom edge of the front panel being connected about a third fold line, the top edge of the back lower flap and the bottom edge of the back panel being connected about a fourth fold line;

wherein at least a portion of the third fold line between the top edge of the front lower flap and the bottom edge of the front panel is arcuate, wherein when the front lower flap and front panel are folded with respect to each other, the arcuate portion of the third fold line imparts tension on the front panel; and wherein at least a portion of each of the front panel and the front upper flap include a fifth fold line that extends in a direction transverse to the third fold line, wherein, when the front upper flap is extended relative to the front panel, the front panel and the front upper flap are bowed at the fifth fold line due to the tension imparted by the arcuate third fold line on the front panel when the front lower flap and front panel are folded with respect to each other.

2. The carton of claim 1, wherein the fifth fold line extends from the arcuate fold line through the front panel and front upper flap.

3. The carton of claim 1, wherein the fifth fold line is located approximately equidistant from the side edges of the front panel and front upper flap.

4. The carton of claim 1 wherein the fifth fold line comprises a score line extending perpendicularly from the arcuate fold line to the top edge of the front upper flap.

5. The carton of claim 1, wherein the fourth fold line between the top edge of the back lower flap and the bottom edge of the back panel is arcuate, wherein when the back lower flap and back panel are folded with respect to each other, the arcuate portion of the fourth fold line imparts tension on the back panel; and a sixth fold line extending from the arcuate fourth fold line through the back panel and the back upper flap to the top edge of the back upper flap, wherein when the back upper flap is extended relative to the back panel, the back panel and the back upper flap are bowed at the sixth fold line due to the tension imparted by the arcuate fourth fold line on the back panel when the back lower flap and back panel are folded with respect to each other.

6. The carton of claim 5, wherein the sixth fold line is located approximately equidistant from the side edges of the back panel and the back upper flap.

7. A reusable carton having an open top when partially erected and configured to be laid on its side for side loading during a packaging process, the carton comprising:

a container body having a series of walls that define a first opening and a second opening;

a first set of flaps supported solely by hinged connections to the walls of the container body and configured to selectively close the first opening;

a second set of flaps hingedly connected to the walls of the container body and configured to selectively close the second opening; and means integrally formed with the container body and the first set of flaps to hold the first set of flaps in an open position when the container body is placed on its side for side loading through the first opening, comprising an arcuate fold line between one of the walls and at least one flap in the second set of flaps, wherein the arcuate fold line imparts tension in the wall when the at least one flap in the second set of flaps is folded about the arcuate fold line, and a transverse fold line that extends transversely relative to the arcuate fold line through at least a portion of the wall and at least one flap in the first set of flaps, wherein, when the at least one flap in the first set of flaps is extended relative to the wall, the tension in the wall causes the wall to bow and is transferred to the at least one flap in the first set of flaps so as to create a fold in the at least one flap in the first set of flaps that maintains the at least one flap in the first set of flaps in the extended position when the container body is placed on its side.

8. The reusable carton of claim 7 wherein the container body includes an arcuate fold line between two of the walls and an opposed pair of flaps in the second set of flaps, wherein the arcuate fold lines impart tension in the walls when either of the flaps of the opposed pair of flaps is folded about the associated arcuate fold line, and a transverse fold line that extends transversely relative to each arcuate fold line through at least a portion of the associated wall and one of the flaps in the first set of flaps, wherein, when one of the flaps in the first set of flaps is extended relative to its associated wall, the tension in the wall causes the wall to bow and is transferred to the associated flap so as to create a fold in the flap that maintains the flap in the extended position when the container body is placed on either of its sides.

9. The reusable carton of claim 8 wherein the container body is made of corrugated board.

10. The reusable carton of claim 7 wherein the second set of flaps includes a third closure flap connected to a first one of the walls and a fourth closure flap connected to a second one of the walls, and wherein one of the third and fourth closure flaps includes a tab portion and the other of the third and fourth closure flaps has a slot for receiving the tab portion when the second set of flaps are positioned to close the second opening.

11. A carton comprising:

a front wall, a back wall, a first side wall, and a second side wall, all of the walls each having a top edge and a bottom edge;

a front upper flap and a back upper flap, each having a top edge and a bottom edge and unsupported side edges, the bottom edge of the front upper flap and the top edge of the front wall being connected about a first fold line, and the bottom edge of the back upper flap and the top edge of the back wall being connected about a second fold line;

a front lower flap and a back lower flap, each having a top edge and a bottom edge, the top edge of the front lower flap and the bottom edge of the front wall being connected about a third fold line, and the top edge of the back lower flap and the bottom edge of the back wall being connected about a fourth fold line;

wherein at least a portion of at least one of the third and fourth fold lines is arcuate, wherein when the lower flap adjacent the arcuate portion of the fold line is folded with respect to the wall adjacent the arcuate portion of the fold line, the arcuate portion of the fold line imparts tension on the wall adjacent the arcuate portion of the fold line; and wherein at least a portion of the wall adjacent the arcuate portion of the fold line and at least a portion of the upper flap connected thereto include a fifth fold line that extends in a direction transverse to the arcuate portion of the fold line, wherein, when the upper flap is extended relative to the wall adjacent the arcuate portion of the fold line, the wall adjacent the arcuate portion of the fold line and the flap connected thereto are bowed at the fifth fold line due to the tension imparted by the arcuate portion of the fold line on the wall adjacent the arcuate portion of the fold line when the lower flap adjacent the arcuate portion of the fold line is folded with respect to the wall adjacent the arcuate portion of the fold line.

* * * * *